US009517551B2

(12) United States Patent
Perez, Jr.

(10) Patent No.: US 9,517,551 B2
(45) Date of Patent: Dec. 13, 2016

(54) FUEL INJECTOR ASSEMBLY APPARATUS AND METHOD

(71) Applicant: LR Inventions, LLC, Miami, FL (US)

(72) Inventor: Ricardo Perez, Jr., Miami, FL (US)

(73) Assignee: LR Inventions, LLC, Miami, FL (US)

( * ) Notice: Subject to any disclaimer, the term of this patent is extended or adjusted under 35 U.S.C. 154(b) by 590 days.

(21) Appl. No.: 13/911,954

(22) Filed: Jun. 6, 2013

(65) Prior Publication Data

US 2014/0359986 A1 Dec. 11, 2014

(51) Int. Cl.
*B25B 27/00* (2006.01)
*F02M 61/16* (2006.01)
*B25B 27/04* (2006.01)

(52) U.S. Cl.
CPC ..... *B25B 27/0035* (2013.01); *B25B 27/04* (2013.01); *F02M 61/168* (2013.01); *Y10T 29/49405* (2015.01); *Y10T 29/53552* (2015.01)

(58) Field of Classification Search
CPC ..... B25B 27/02; B25B 27/023; B25B 27/14; B25B 27/24
See application file for complete search history.

(56) References Cited

U.S. PATENT DOCUMENTS 2,219,739 A * 10/1940 Duncan ..... B25C 1/001 227/113
2,632,890 A * 3/1953 Tietig ..... B25C 1/10 227/10
3,387,354 A * 6/1968 Mossberg ..... B60C 25/18 29/221.5
3,739,452 A * 6/1973 Gadberry ..... B25B 27/02 29/254
4,807,343 A * 2/1989 Wadsworth ..... B25B 27/02 227/142
5,020,203 A * 6/1991 Rix ..... B25B 27/0035 29/255
5,299,346 A 4/1994 Kilgore et al.
5,499,612 A 3/1996 Haughney et al.
5,651,345 A 7/1997 Miller et al.
5,803,108 A * 9/1998 Schuessler, Jr. ..... B60C 29/062 137/15.08
5,813,104 A * 9/1998 Quick ..... B25B 27/02 29/235
5,960,774 A * 10/1999 Norgauer ..... B25B 27/0035 123/470
6,418,617 B2 7/2002 Taylor
(Continued)

*Primary Examiner* — Joseph J Hail
*Assistant Examiner* — Tyrone V Hall, Jr.
(74) *Attorney, Agent, or Firm* — Pablo Meles

(57) ABSTRACT

A fuel injector assembly tool includes a frame coupled to a gun body, and a push rod configured to traverse through the frame and the gun body, the gun body having a fixed handle and a trigger for causing distal movement of the push rod as the trigger moves towards the fixed handle. The tool further includes a pressure rod coupled to or forming a portion of the push rod, the pressure rod being arranged and constructed to apply pressure to a tip of a fuel injector to compress springs within the fuel injector and maintain internal alignment of fuel injector components. In one arrangement, the tool includes a pressure rod adaptor nut coupling the push rod to the pressure rod. A method of re-assembly of a fuel injector using the fuel injector assembly tool is disclosed. Additional embodiments are disclosed.

13 Claims, 8 Drawing Sheets

(56) References Cited

U.S. PATENT DOCUMENTS

| | | | | |
|---|---|---|---|---|
| 6,739,034 | B2 * | 5/2004 | Suzuki | B23P 19/00 242/432.2 |
| 6,908,016 | B2 | 6/2005 | Chen | |
| 8,621,991 | B1 * | 1/2014 | Lopez | B25B 27/26 100/219 |
| 2013/0036607 | A1 | 2/2013 | Takasaki et al. | |

* cited by examiner

FUEL INJECTOR ASSEMBLY APPARATUS AND METHOD

CROSS-REFERENCE TO RELATED APPLICATIONS

N/A.

FIELD

The embodiments relate to assembly and reassembly of fuel injectors and tools therefore.

BACKGROUND

Fuel injector systems are complicated and tricky to disassemble and reassemble. One type of fuel injector system is a hydraulically actuated electronic unit injection (HEUI) fuel injector system. In a HEUI system, fuel injectors send fuel under high pressure (e.g., at pressures up to greater than 20,000 psi) into the respective engine cylinders. The HEUI system can include an upper assembly, a main body with internal components and a cap. The internal components within the body and cap can have many small pieces including a number of dowels, pins, sleeves, stops and springs. Close attention to placement and positioning of the parts during assembly and disassembly goes without saying. Assembly or reassembly can involve manually placing portions of the HEUI fuel injector system under compression and further using a driver tool or alignment tool.

At a certain juncture of disassembly, the cap is unscrewed from the body of the injector to access the internal components. The body has flat spots making it easy to hold, but the cap is round making the cap difficult to grasp. During assembly or reassembly components are stacked in place, but at least several areas where the springs hold the parts too far apart make alignment difficult when it comes time for screwing the cap on to the main body and its internal components. The alignment of dowels and spacers can be difficult to maintain as springs are compressed. Such difficulty can involve the compression of a nozzle spring and an amplifier spring for example. Manually compressing the springs while trying to screw the cap on while further trying to keep all the components lined up can become an burdensome chore.

SUMMARY

One embodiment of the present disclosure can entail a tool including a modified caulking gun assembly having a gun rack, a gun body, and a push rod configured to traverse through the gun rack and the gun body, the gun rack having a fixed handle and a trigger for causing distal movement of the push rod as the trigger moves towards the fixed handle. The tool further includes a pressure rod adaptor nut coupled to the push rod and a pressure rod coupled to the push rod via the pressure rod adaptor nut, the pressure rod being arranged and constructed to apply pressure to a tip of an injector.

Another embodiment of the present disclosure can entail a fuel injector assembly tool including a frame coupled to a gun body, and a push rod configured to traverse through the frame and the gun body, the gun body having a fixed handle and a trigger for causing distal movement of the push rod as the trigger moves towards the fixed handle. The fuel injector assembly tool further includes a pressure rod adaptor nut coupled to the push rod and a pressure rod coupled to the push rod via the pressure rod adaptor nut, the pressure rod being arranged and constructed to apply pressure to a tip of a fuel injector to compress springs within the fuel injector and maintain internal alignment of fuel injector components.

Yet another embodiment of present disclosure can entail a method including fixing a lower injector housing portion of the fuel injector assembly in a fixed position with a vice, separating a body from the fuel injector assembly from the upper injector housing portion and exposing internal components, loosening the lower injector housing portion from the vice, inverting the lower injector housing portion and vertically feeding the lower injector housing up a push rod configured to traverse through a frame and a gun body of a fuel injector assembly tool, the gun body having a fixed handle and a trigger for causing distal movement of the push rod as the trigger moves towards the fixed handle. The method further includes magnetically holding the lower injector housing in place up a portion of the pushrod, inverting the body of the fuel injector assembly and placing the body on a front end of the frame constructed to fit the body, fixing the body and the front end of the frame within the vice, building up the internal components of the fuel injector upon the body forming a built-up body having a tip, aligning the lower injector housing with the built-up body using the push rod, decoupling the lower injector housing from at least one magnet coupled to the lower injector housing, mating the lower injector housing with the built-up body by sliding the lower injector housing down the push rod and having the tip of the built-up body protruding through a center of the body, actuating the trigger to apply pressure to the tip to compress springs within the fuel injector and maintain internal alignment of fuel injector components, and rotating the lower injector housing on threads of the body to fix the lower injector housing to the built-up body to form a fuel injector sub-assembly.

DETAILED DESCRIPTION

Figure 1:
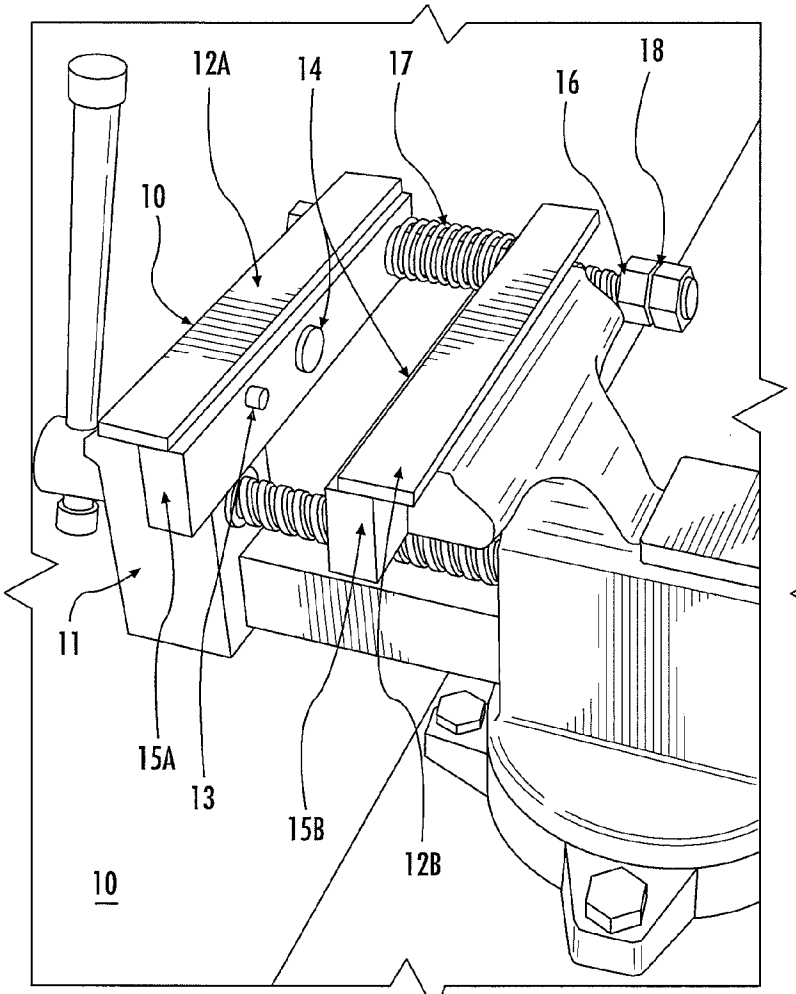
FIG. 1 is perspective view of a injector holder serving as an adaptor tool within a vice in accordance with the embodiments.

Referring to FIG. 1, an injector holder 10 servers as an adaptor to a vice 11 to hold an fuel injector in place during disassembly and assembly. The injector holder 10 can include opposing bracket members 15A and 15B including corresponding shelf members 12A and 12B. The bracket members 15A and 15B are coupled together via a spring loaded bolt 16 and nut 18 and are biased apart using a spring 17 loaded on the bolt 16. One or more of the bracket members 15A or 15B can include one or more detents or pins 13 for maintaining placement of the injector 20 (see FIG. 2) and one or more magnets 14 for further securing the injectors within the injector holder 10 and vice 11. The injector holder 10 stays securely within the arms of the vice since the shelf members 12A and 12B lie on top of the arms of the vice and further when the arms of the vice are within a predetermined distance of each other, the spring 17 of the spring loaded bolt 16 forces the bracket members 15A and 15B against the respective arms of the vice 11. In other words, the injector holder 10 includes two alignment plates spring biased in opposing directions and constructed to fit within the vice 11, wherein each alignment plate can include a guide pin 13 arranged to maintain placement of a lower injector housing or cap of the injector.

Figure 2:
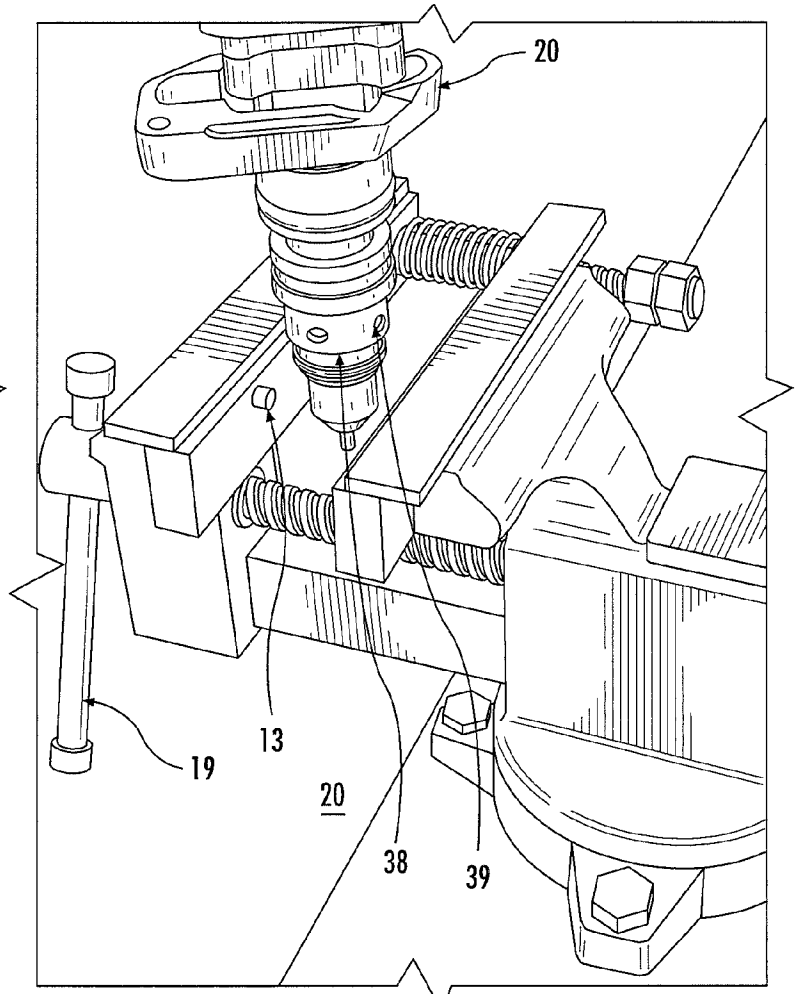
FIG. 2 illustrates the injector holder of FIG. 1 as an injector is being placed within the vice and injector holder in accordance with the embodiments.

Referring to FIG. 2, a fuel injector 20 such as a HEUI fuel injector is placed within the opposing bracket members 15A and 15B of the injector holder 10 within the vice 11. A vice adjustment handle 19 is turned to adjust the arms of the vice 11 and correspondingly the opposing bracket members 15A and 15B. The pin 13 mates with a hold or aperture 39 within a cap 38 of the fuel injector 20 to maintain placement of the fuel injector 20 as noted above.

Figure 2A:
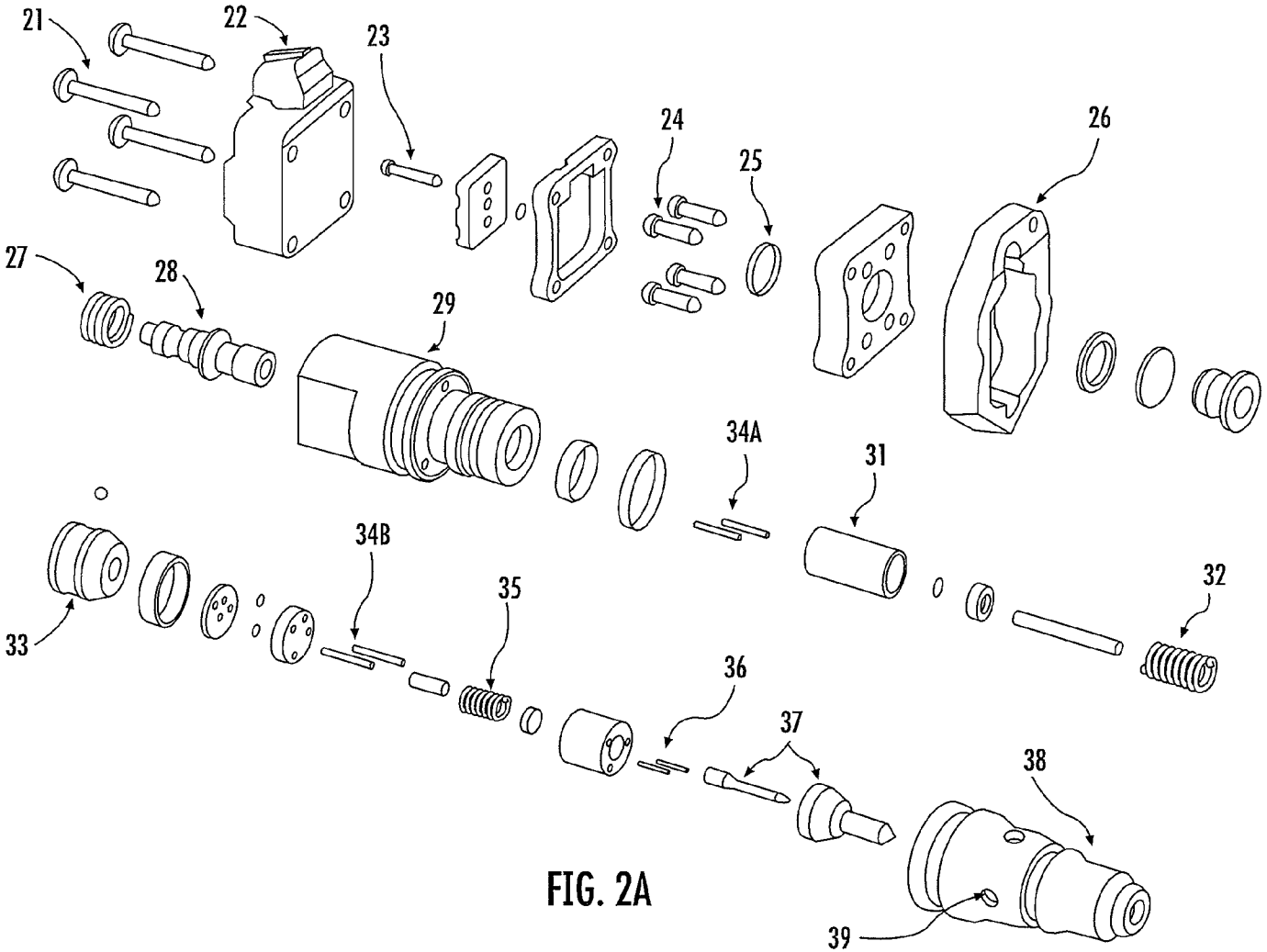
FIG. 2A is an exploded perspective view of an HEUI fuel injector.

FIG. 2A is an exploded view of a fuel injector 20 such as a HEUI fuel injector. The fuel injector includes an upper assembly, a main body 29 having a number of internal components and a cap 38. The upper assembly can include solenoid screws 21 for attaching a solenoid 22 to the rest of the upper assembly which can include a poppet screw 23, an armature, a poppet shim, a solenoid spacer, assembly screws 24 and o-ring seal 25, an oil relief plate, and a clamp 26. Between the upper assembly and the body 29 can further include an oil relief spacer, a travel shim, a sleeve, a poppet spring 27 and a poppet valve 28 as shown. Below the body 29 or between the body 29 and the cap 38 are o-ring seals, dowels 34A, an amplifier 31, a retaining ring, button, plunger, and amplifier spring 32. Between the body 29 and the cap 38 can further include a barrel 33, one or more check balls, a retaining spring, a stop place, a check plate, a stop, dowels 34B, a nozzle spring 35, a lift spacer, a spacer sleeve, more dowels 36, and a nozzle assembly 37 that protrudes through the bottom of the cap 38. As noted above, the cap includes one or more holes or apertures or indentations 39.

Figure 3C:
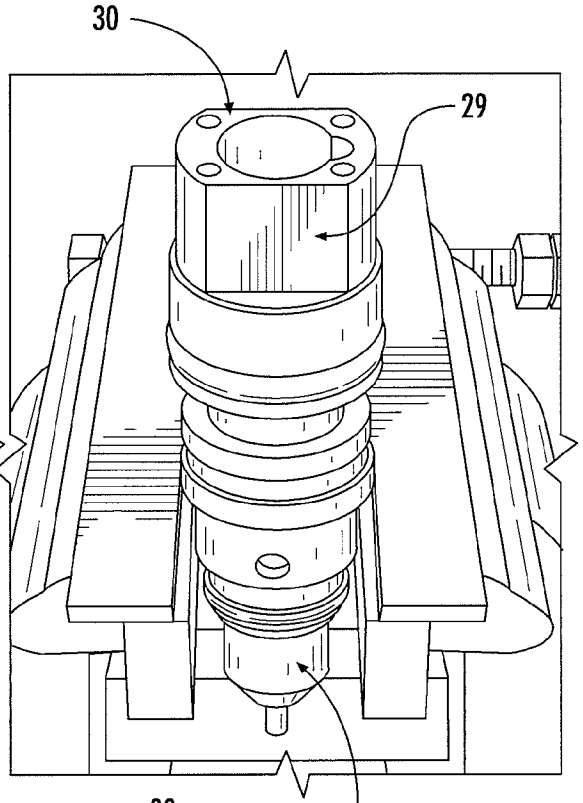
FIG. 3C illustrates the removal of all of the upper assembly including the removal of a clamp and poppet valve in accordance with the embodiments.
Figure 3B:
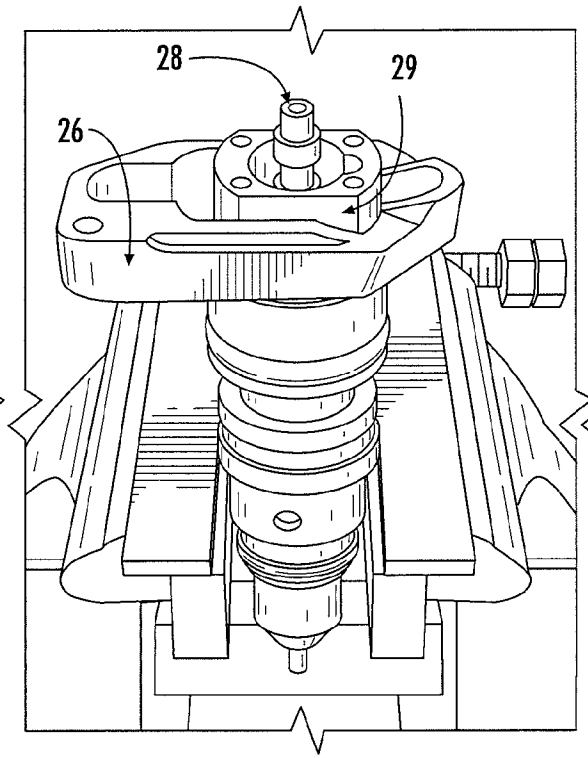
FIG. 3B illustrates the removal of most of the upper assembly of the fuel injector in accordance with the embodiments.
Figure 3A:
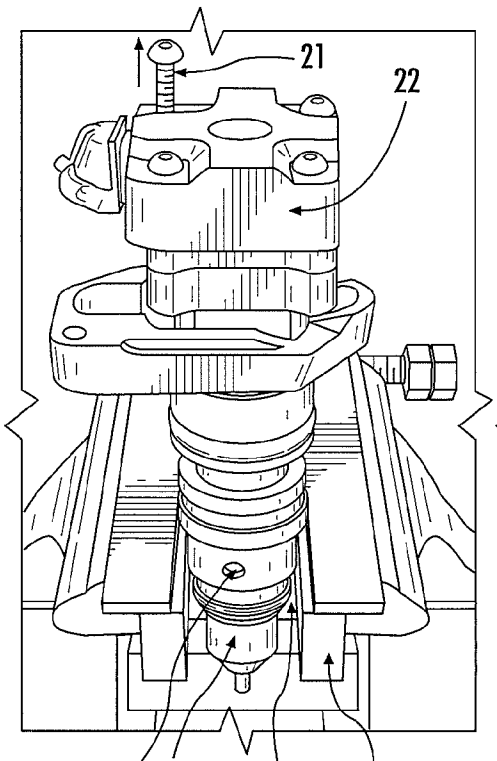
FIG. 3A illustrates the HEUI fuel injector within the injector holder and vice as a solenoid screw is being removed from an upper assembly of the fuel injector in accordance with the embodiments herein.

Once the fuel injector 20 is secured in place within the brackets 15A and 15B of injector holder 10 as shown in FIG. 3A, disassembly of the of the fuel injector 20 can begin. Besides the brackets, the pin 13 (not shown) of the bracket 15A mates with one of the holes 39 of the cap 39 to keep the fuel injector in place during disassembly or assembly. Furthermore, the magnet or magnets 14 couples with the cap 38 to keep the fuel injector in place during disassembly as well. Disassembly begins by removing the solenoid screws 21 from the solenoid 22 from the upper assembly. Once the solenoid 22 is removed, other portions of the upper assembly can be removed including the poppet screw 23, the armature, the poppet shim, the solenoid spacer, the assembly screws 24 and o-ring seal 25, and the an oil relief plate (see FIG. 2A) until the poppet valve 28, main body 29 and clamp 26 are exposed as shown in FIG. 3B. Once the poppet valve 28 is removed from within the main body 29 and the clamp 26 is slide off the main body 29, an assembly 30 as shown in FIG. 3C remains that includes the main body 29, the cap 38 and the internal components in-between. Note, the top of the main body 29 has a rectangular shaped head.

Figure 4B:
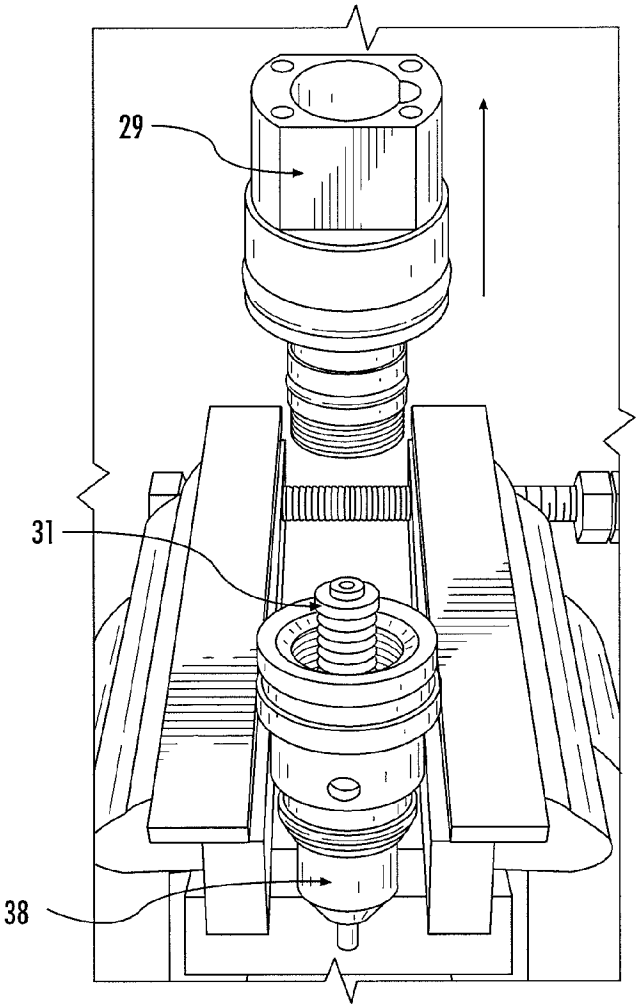
FIG. 4B shows the main body of the fuel injector separated from the lower portion or cap of the fuel injector in accordance with the embodiments.
Figure 4A:
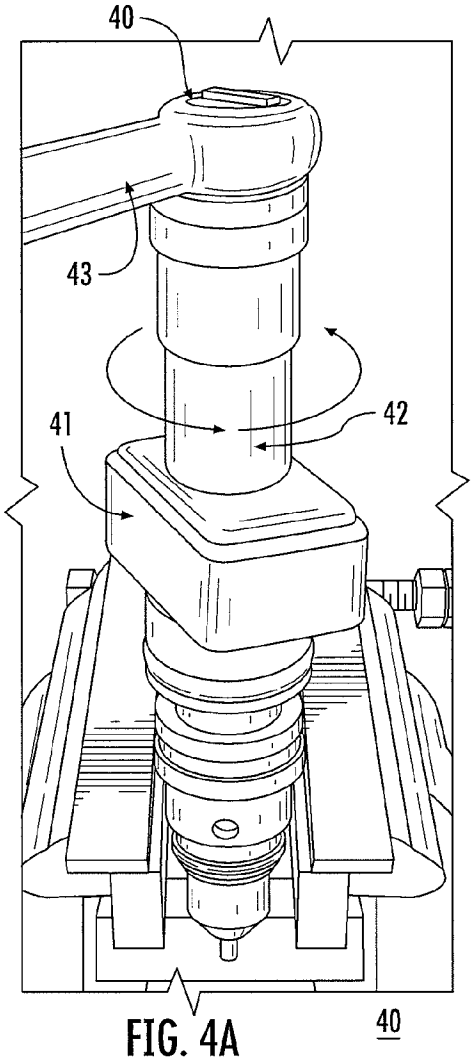
FIG. 4A illustrates a rectangular socket, drive ratchet and socket wrench tool applied to a main body in the disassembly of the fuel injector in accordance with the embodiments.

The main body 29 and the cap 28 are screwed on to each other. To unscrew them or disassemble them, a specialized tool 40 is used as shown in FIG. 4A. The specialized tool can include a rectangular shaped socket 41 coupled to a ratchet driver 42 and a socket wrench 43 which is constructed to apply a torque to a main body of the injector. Once the specialized tool 40 is placed on the main body 29, the wrench can be turned counterclockwise to unscrew the main body 29 from the cap 38 as shown in FIG. 4B. Once the main body is removed from the cap 38, some of the internal components are exposed including the amplifier 31. Once all the internal components are removed, assembly or re-assembly can begin.

Figure 5D:
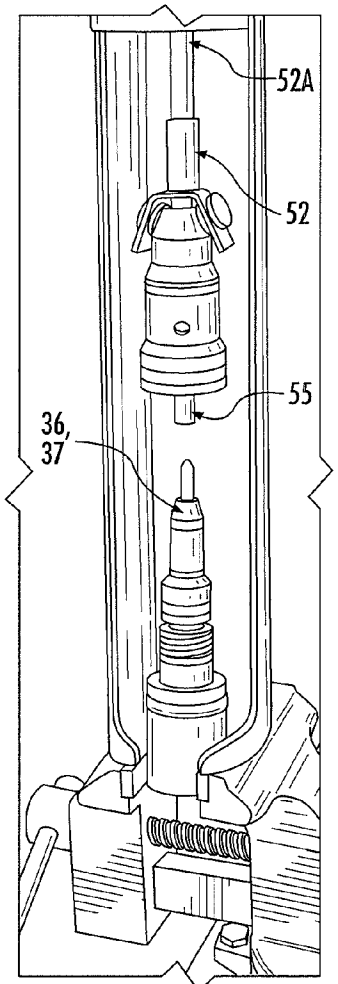
FIGS. 5A-5G illustrates the various steps in the reassembly of a fuel injector using a fuel injector assembly tool in accordance with the embodiments.
Figure 5C:
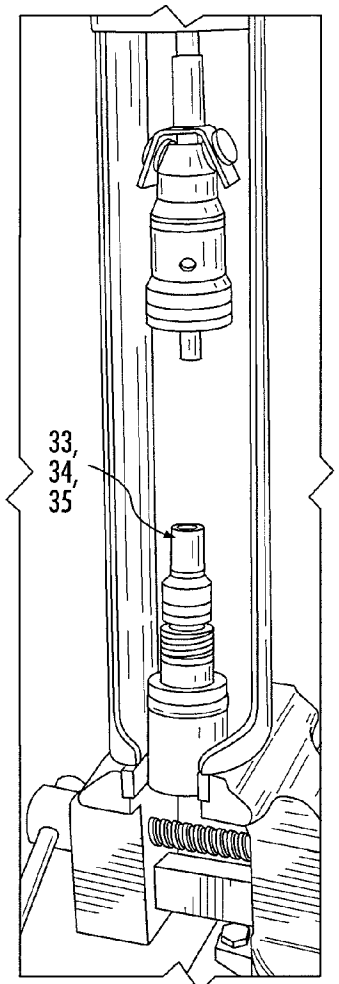
Figure 5B:
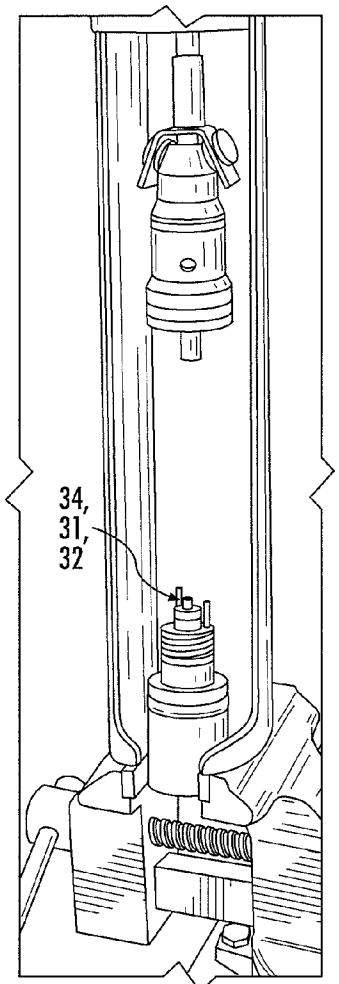
Figure 5A:
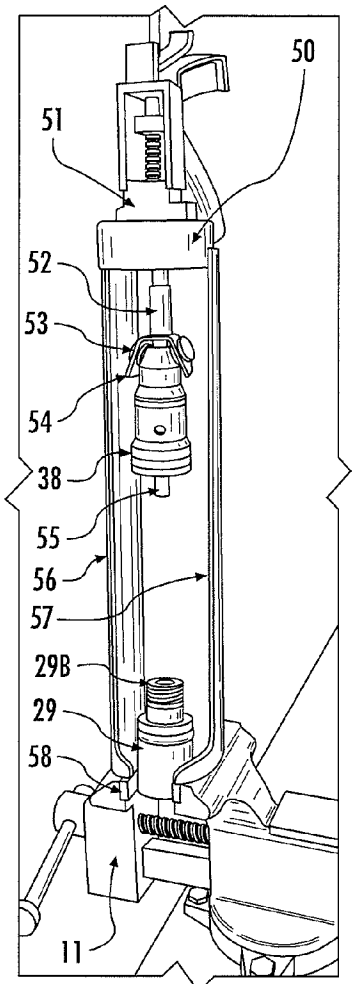
Figure 5G:
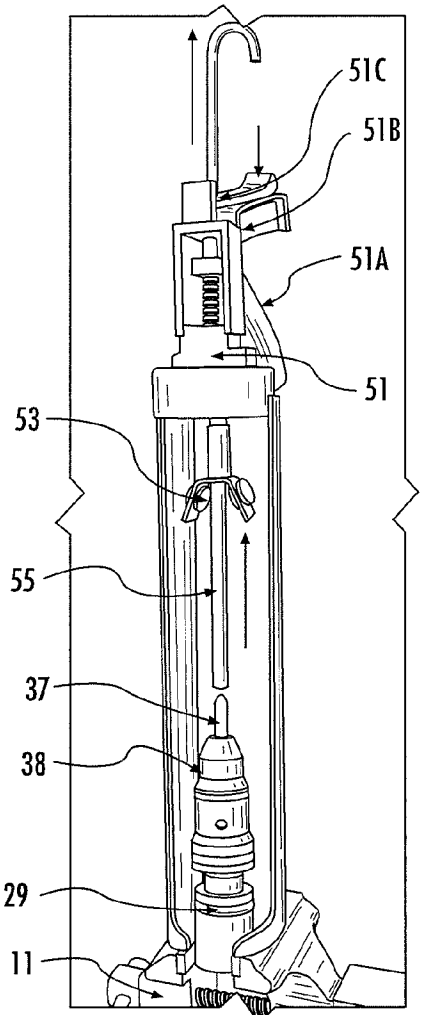

FIGS. 5A through 5G illustrates assembly or re-assembly of a fuel injector from the main body 29 "down" to the cap 38 using a tool 50 in accordance with the embodiments. The main body 29 and cap 38 are inverted and placed within the tool 50 and internal components are built up upon a bottom portion 29B of the main body 29 as shown in FIG. 5A. The tool 50 can be a fuel injector assembly tool 50 in one embodiment being a modified caulking gun assembly having a gun rack 56 and 57, a gun body 51, and a push rod 52A configured to traverse through the gun rack and the gun body, the gun body 51 having a fixed handle 51A and a trigger 51B as shown in FIGS. 5D and 5G for causing distal movement of the push rod 52A as the trigger 51B moves towards the fixed handle 51A. The tool 50, in one embodiment, can further include a pressure rod adaptor nut 52 coupled to the push rod 52A, and a pressure rod 55 coupled to the push rod 52A via the pressure rod adaptor nut 52, the pressure rod 55 being arranged and constructed to apply pressure to a tip (or nozzle assembly) 37 of a fuel injector to compress springs within the injector and maintain internal alignment of components of the injector during assembly or re-assembly In one arrangement, the tool 50 includes at least one magnet 53 coupled to the pressure rod adaptor nut 52 and arranged and constructed to hold a lower injector housing or cap 38 of the injector in place for assembly. In one arrangement, the tool 50 can further include a release lever 51C behind the fixed handle as shown in FIG. 5G enabling the distal extension of the push rod 52A in a forward or backward direction. A front end 58 of the gun rack (56 and 57) can be constructed to fit an upper injector housing of the injector or the top end of the main body 29 (the side opposing the bottom end 29B).

The fuel injector assembly tool 50 can also be described as having a frame 56, 57 and 58 coupled to a gun body 51, and a push rod 52A configured to traverse through the frame and the gun body, the gun body 51 having a fixed handle 51A and a trigger 52B for causing distal movement of the push rod 52A as the trigger moves towards the fixed handle.

The fuel injector assembly tool 50 can include as explained above the pressure rod adaptor nut 52 coupled to the push rod 52A, and the pressure rod 55 coupled to the push rod 52A via the pressure rod adaptor nut 52, the pressure rod 55 being arranged and constructed to apply pressure to a tip 37 of a fuel injector to compress springs within the fuel injector and maintain internal alignment of fuel injector components.

Figure 5F:
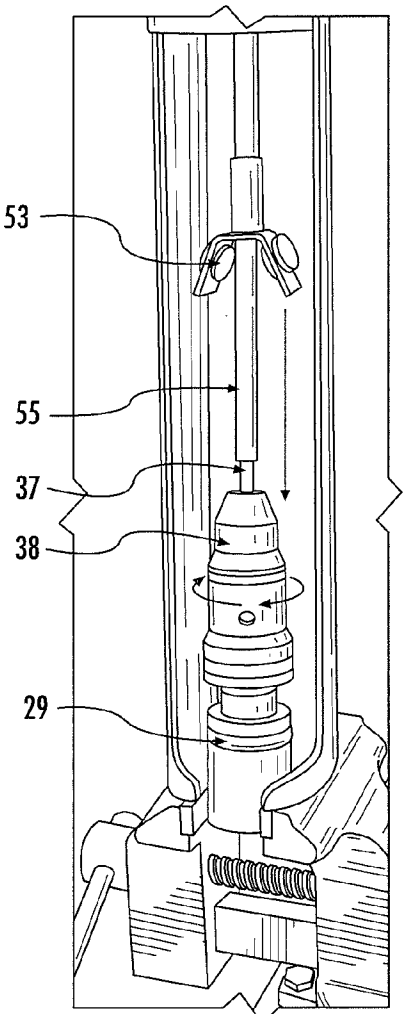

The fuel injector assembly tool 50 enables the application of pressure of compressing the springs in the injector while every component remains lined up. One of the key steps as shown in FIG. 5F involves keeping the internal springs compressed while screwing the cap 38 on. The fuel injector assembly tool 50 thus serves among other purposes as a fixture to compress everything while the cap is installed. Note, the pressure rod 55 is hollow inside to enable the pressure rod 55 to press down against the outer part of the nozzle 37.

Another embodiment in accordance with the embodiments herein entails a method which can be illustrated with FIGS. 3A-3C, 4A-4B, 5A-5G and 6A-6C. The method can begin by fixing a lower injector housing portion of the fuel injector assembly or cap 38 in a fixed position with a vice 11 as shown in FIG. 3A, and separating a body such as the main body 29 of the fuel injector assembly from the upper injector housing portion (21-25) and exposing internal components of the injector as in FIG. 3B. A clamp 26 can be slipped off of the main body 29 and a poppet valve 28 (and other components) can be further removed from the inside of the main body 29 so that an assembly 30 remains as shown in FIG. 3C consisting of the main body 29 and cap 38 with internal components between (not shown).

Next, as shown in FIG. 4A, a socket wrench tool 40 can optionally be used to loosen the main body 29 from the cap 38 exposing internal components within the cap 38 such as an amplifier 31 as shown in FIG. 4B. The socket tool wrench 40 includes the rectangular socket 41, the ratchet driver 42, and socket wrench 43. The socket 41 is placed over the head of top of the main body 29 and the socket wrench is torqued or turned counterclockwise to remove the main body 29 from the cap 38.

The lower injector housing portion or cap 38 is loosened from the vice 11 and inverted and vertically fed up a push rod 52 and/or pressure rod 55 configured to traverse through a frame (56 and 57) and a gun body 51 of the fuel injector assembly tool 50 as illustrated in FIGS. 5A-5G. The gun body 51 has a fixed handle 51A and a trigger 51 B for causing distal movement of the push rod 52A (and consequently the pressure rod 55) as the trigger 51B moves towards the fixed handle 51A. One or more magnets 53 can be used to magnetically hold the lower injector housing or cap 38 up against a bracket 54 containing the magnets 53 to retain the cap 38 in place up a portion of the pushrod or pressure rod 55. The main body 29 is also inverted and placed on a front end 58 of the frame (56 and 57) and constructed to fit the main body 29. While the main body 29 is fit within the front end, the main body 29 and the front end 58 are fixed within the vice as shown in FIG. 5A.

Figure 5E:
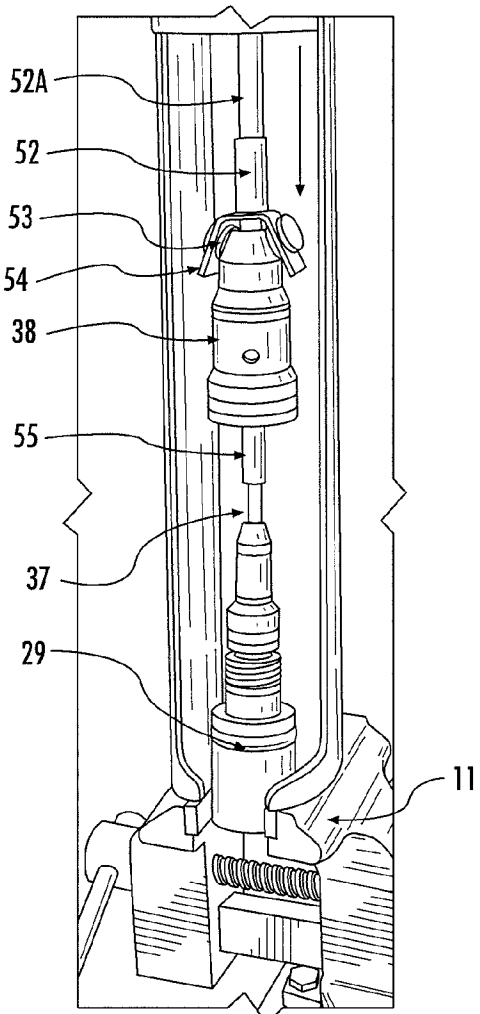

FIGS. 5B-5D show the building up of the internal components of the fuel injector upon the main body 29 and forming a built-up body having a tip 37. As shown in FIGS. 5D and 5E, the method next entails aligning the lower injector housing or cap 38 with the built-up main body 29 using the push rod 52A and consequently the pressure rod 55. As shown in FIG. 5F, once the cap 38 and built-up main body 29 (including the tip 37) are aligned, the method entails decoupling the lower injector housing or cap 38 from at least one magnet 53 and mating the lower injector housing 38 with the built-up body (29) by sliding the lower injector housing or cap 38 down the pressure rod 55 and having the tip 37 of the built-up body 38 protrude through a center of the body. While the pressure rod 55 remains coupled to the tip 37, the springs within the fuel injector can be compressed while further maintaining internal alignment of fuel injector components by actuating the trigger 51B to apply pressure from the pressure rod 55 to the tip 37. At this juncture in FIG. 5F or FIG. 5G, it would be prudent to rotate the lower injector housing or cap 38 (at least some) on to the threads of the main body 29 to fix the lower injector housing to the built-up body to form a fuel injector sub-assembly 30 before releasing the push rod 52A or pressure rod 55 from the tip 37 protruding from a center of the lower injector housing or cap 38. A release lever 51C can be used to release the push rod 52A and/or pressure rod 55. The different members of the fuel injector assembly tool 50 can be more clearly seen in FIG. 7 in an empty state where the members of the fuel injector are removed.

Figures 6A, 6B, 6C:
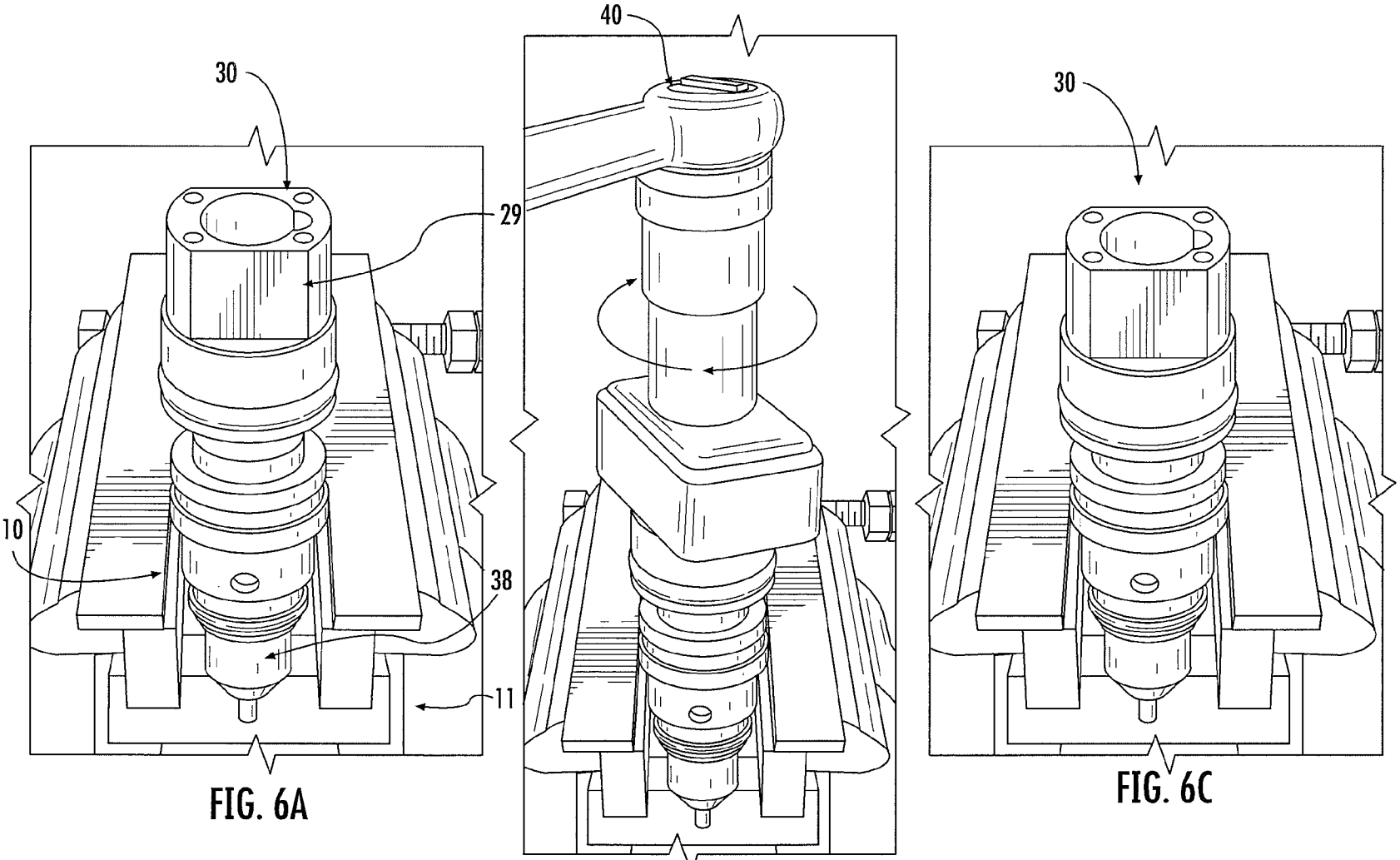
FIGS. 6A-C illustrate the various steps in securing the main body of the fuel injector to the lower portion or cap using the a rectangular socket, drive ratchet and socket wrench tool of FIG. 4A.

The fuel injector sub-assembly 30 and the fuel injector assembly tool 50 can be removed from the vice 11 and the fuel injector sub-assembly 30 can be further removed from the fuel injector assembly tool 50. Once again, the injector holder 10 is placed in the vice 11 and the fuel injector subassembly 30 can be inverted once more and fixed within the vice 11 as shown in FIG. 6A. As shown in FIGS. 6A and 6B, the same socket tool wrench 40 used for disassembly can be used once again to tighten the main body 29 onto the cap 38 by turning the main body in a clockwise direction. As explained above with respect to disassembly applies with assembly in that the fuel injector subassembly 30 is fixed within the injector holder 10 comprising two alignment plates (15A and 15B) spring biased in opposing directions and constructed to fit within the vice 11 where each alignment plate can include a guide pin (13) arranged to maintain placement of the cap 38. At least one magnet can be embedded within at least one of the two alignment plates.

Figure 7:
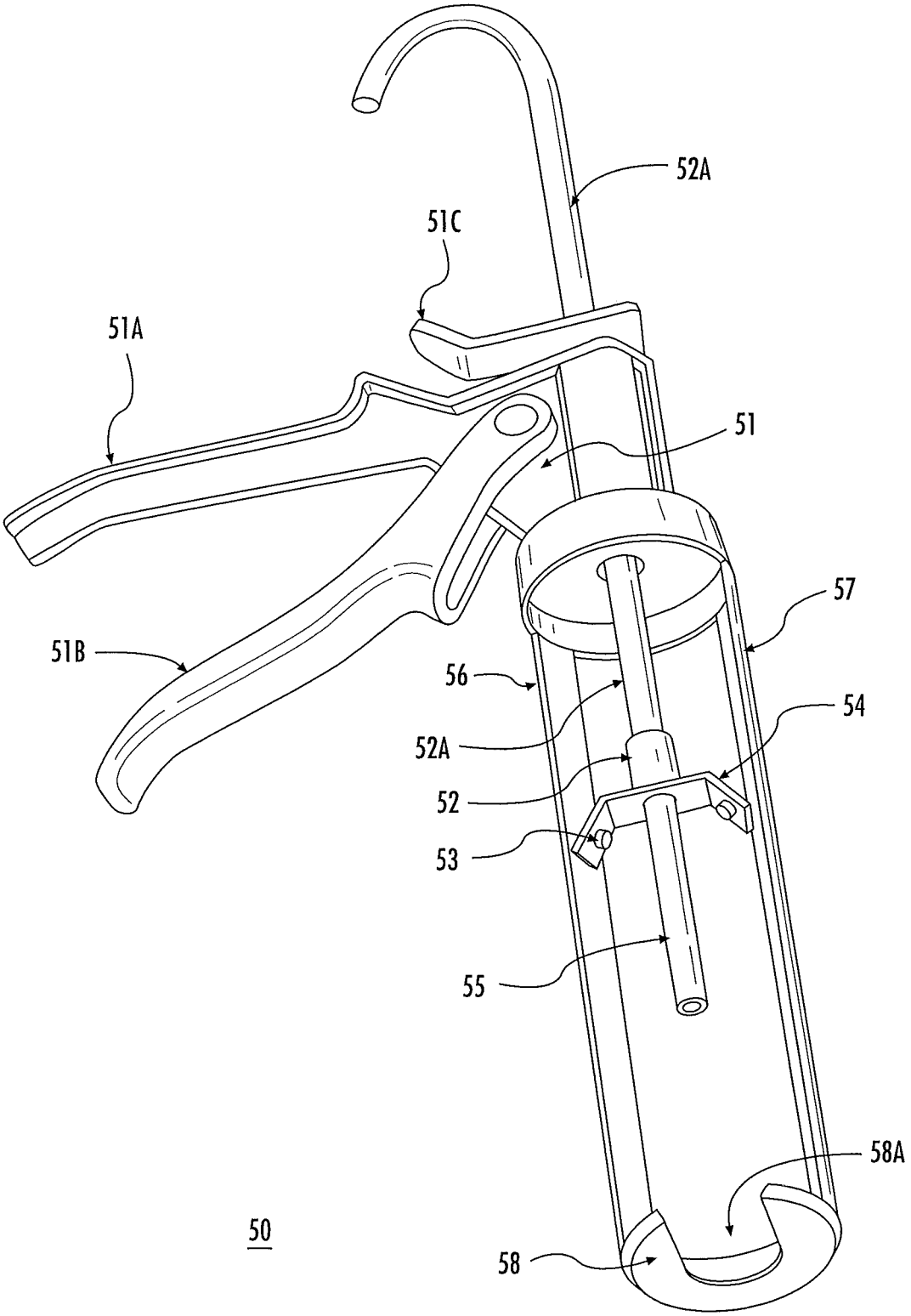
FIG. 7 is a front left perspective view of the fuel injector assembly tool in FIGS. 5A-5G in accordance with the embodiments.

Referring to FIG. 7, a perspective view of the fuel injector assembly tool 50 is shown empty without any fuel injector parts. The fuel injector assembly tool 50 includes a frame comprising of members 56, 57, and 58 and a gun body 51. The gun body includes the fixed handle 51A, the trigger 51B and optionally, the release 51C. The activation of the trigger 51B causes the distal movement of the push rod 52A (and consequently the pressure rod 55) as the trigger 51B moves towards the fixed handle 51A. One or more magnets 53 magnetically holds the lower injector housing or cap (38) using a metal bracket 54 that holds the one or more magnets 53 to maintain the cap 38 in place up a portion of the pressure rod 55. The push rod 52A, which extends from one end of the gun body 51 to an opposing end that terminates at the end of the pressure rod 55, can be viewed and constructed as one contiguous part and potentially avoid certain parts such as the pressure rod adaptor nut 52. However, in this embodiment, the pressure rod adaptor nut 52 couples one end of the push rod 52A to the pressure rod 55, the pressure rod 55 being arranged and constructed to apply pressure to the tip 37 of a fuel injector to compress springs within the fuel injector and maintain internal alignment of fuel injector components. The pressure rod 55 (or if alternatively used, a contiguous push rod 52A) should include a hollow end to go over the tip 37 of the fuel injector as shown previously in FIGS. 5E and 5F. The adaptor nut 54 can also be used to keep in place the bracket 54 that holds the one or more magnets 53. As previously explained above, the frame of the fuel injector assembly tool 50 includes a front end 58 that can be constructed with a slot 58A to fit an upper injector housing (or upper portion of the main body 29) to help further stabilize the main body 29 within the vice 11 during reassembly of the fuel injector.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While the invention has been shown and described with reference to a certain embodiment thereof, it will be understood by those skilled in the art that various changes in form and details may be made therein without departing from the spirit and scope of the invention. Consequently, the scope of the invention should not be limited to the embodiment, but should be defined by the appended claims and equivalents thereof.

What is claimed is:

1. A tool, comprising:

a modified caulking gun assembly having a gun rack, a gun body, and a push rod configured to traverse through the gun rack and the gun body, the gun body having a fixed handle and a trigger for causing distal movement of the push rod as the trigger moves towards the fixed handle;

a pressure rod adaptor nut coupled to the push rod;

a pressure rod coupled to the push rod via the pressure rod adaptor nut, the pressure rod configured to apply pressure to a tip of an injector; and at least one magnet coupled to the pressure rod adaptor nut and arranged and constructed to hold a lower injector housing of the injector in place for assembly.

2. The tool of claim 1, comprising two magnets coupled to the pressure rod adaptor nut and arranged and constructed to hold a lower injector housing of the injector in place for assembly.

3. The tool of claim 1, comprising a release lever behind the fixed handle enabling the distal extension of the push rod in a forward or backward direction.

4. The tool of claim 1, comprising a front end of the gun rack constructed to fit an upper injector housing of the injector.

5. The tool of claim 1, further forming a system operating cooperatively with a rectangular socket coupled to a drive ratchet constructed to torque a body of the injector.

6. The tool of claim 1, further forming a system operating cooperatively with an injector holder comprising two alignment plates spring biased in opposing directions and constructed to fit within a vice, wherein each alignment plate includes a guide pin arranged to maintain placement of a lower injector housing of the injector.

7. The tool of claim 6, the system further comprising at least one magnet embedded within at least one of the two alignment plates.

8. The tool of claim 1, wherein the tool is configured to assemble or disassemble the injector in the form of a hydraulically actuated electronic unit injection (HEUI) fuel injector system.

9. The tool of claim 1, wherein the pressure rod is configured to apply pressure to a tip of the injector to compress springs within the injector and maintain internal alignment of components of the injector during assembly.

10. A fuel injector assembly tool, comprising:

a frame coupled to a caulking gun body, and a push rod configured to traverse through the frame and the caulking gun body, the caulking gun body having a fixed handle and a trigger for causing distal movement of the push rod as the trigger moves towards the fixed handle; and a pressure rod coupled to or forming a portion of the push rod, the pressure rod being configured to apply pressure to a tip of a fuel injector to compress springs within the fuel injector and maintain internal alignment of fuel injector components; and at least one magnet coupled to a pressure rod adaptor nut that couples the push rod to the pressure rod and is arranged and constructed to hold a lower injector housing of the fuel injector in place for assembly.

11. The fuel injector assembly tool of claim 10, wherein the tool is configured to assemble or disassemble the injector in the form of a hydraulically actuated electronic unit injection (HEUI) fuel injector system.

12. The fuel injector assembly tool of claim 10, comprising at least two magnets coupled to a pressure rod adaptor nut that couples the push rod to the pressure rod and is arranged and constructed to hold a lower injector housing of the fuel injector in place for assembly.

13. The fuel injector assembly tool of claim 10, further comprising a release lever behind the fixed handle enabling the distal extension of the push rod in a forward or backward direction.

* * * * *